US009221249B2

(12) United States Patent
Kuki et al.

(10) Patent No.: US 9,221,249 B2
(45) Date of Patent: Dec. 29, 2015

(54) DROPLET DISCHARGE DEVICE AND METHOD FOR DRIVING DROPLET DISCHARGE HEAD

(75) Inventors: Takakazu Kuki, Fuchu (JP); Katsuaki Komatsu, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/003,740

(22) PCT Filed: Feb. 23, 2012

(86) PCT No.: PCT/JP2012/054378
§ 371 (c)(1),
(2), (4) Date: Sep. 6, 2013

(87) PCT Pub. No.: WO2012/121019
PCT Pub. Date: Sep. 13, 2012

(65) Prior Publication Data
US 2013/0335468 A1 Dec. 19, 2013

(30) Foreign Application Priority Data
Mar. 8, 2011 (JP) ..... 2011-049999

(51) Int. Cl.
*B41J 29/38* (2006.01)
*B41J 2/045* (2006.01)

(52) U.S. Cl.
CPC ..... *B41J 2/04541* (2013.01); *B41J 2/0456* (2013.01); *B41J 2/0459* (2013.01);
(Continued)

(58) Field of Classification Search
CPC . B41J 2/04526; B41J 2/04543; B41J 2/04545
See application file for complete search history.

(56) References Cited

U.S. PATENT DOCUMENTS 7,178,893 B2 * 2/2007 Noda ..... 347/10
2004/0155915 A1 * 8/2004 Kitami et al. ..... 347/10
(Continued)

FOREIGN PATENT DOCUMENTS

JP 07-256884 A 10/1995
JP 11-300964 A 11/1999
(Continued)

OTHER PUBLICATIONS

Machine generated English translation of JP2005-186397A to Nakanishi Kanzo, "Inkjet Recording Device," obtained via http://www19.ipdl.inpit.go.jp/PA1/cgi-bin/PA1INDEX on Jul. 9, 2014; 8 pp.*
(Continued)

*Primary Examiner* — Shelby Fidler
(74) *Attorney, Agent, or Firm* — Holtz, Holtz, Goodman & Chick PC

(57) ABSTRACT

A droplet discharge device having a droplet discharge head provided with a plurality of nozzles that discharge droplets; a plurality of pressure chambers communicating with the nozzles; and a plurality of pressure generating units for changing a capacity of each pressure chamber by applying a drive signal. The drive signal includes an expansion pulse and a contraction pulse, and the plurality of nozzles are divided into a plurality of groups each comprising one or more nozzles. A drive voltage value of the expansion pulse is set to be common to the respective groups. The drive signal which has a drive voltage value of the contraction pulse independently set in accordance with a droplet speed level for each group is applied to the droplet discharge head, and the droplets are discharged.

10 Claims, 11 Drawing Sheets

(52) U.S. Cl.
CPC ..... *B41J2/04506* (2013.01); *B41J 2/04561* (2013.01); *B41J 2/04581* (2013.01); *B41J 2/04588* (2013.01); *B41J 2/04596* (2013.01); *B41J 2202/10* (2013.01)

(56) References Cited

U.S. PATENT DOCUMENTS

| | | | | |
|---|---|---|---|---|
| 2007/0206055 | A1* | 9/2007 | Zapka et al. | 347/54 |
| 2008/0225069 | A1 | 9/2008 | Miyazawa | |
| 2009/0073205 | A1* | 3/2009 | Liu et al. | 347/10 |
| 2012/0007906 | A1* | 1/2012 | Zhang | 347/14 |

FOREIGN PATENT DOCUMENTS

| | | | | |
|---|---|---|---|---|
| JP | 2004-090621 | A | | 3/2004 |
| JP | 2005186397 | A | * | 7/2005 |
| JP | 2006-137124 | A | | 6/2006 |
| JP | 2006-167924 | A | | 6/2006 |
| JP | 2008-221759 | A | | 9/2008 |

OTHER PUBLICATIONS

International Search Report (ISR) dated Mar. 19, 2012 (and English translation thereof) in International Application No. PCT/JP2012/054378.

Extended European Search Report dated Sep. 23, 2014, issued in counterpart European Application No. 12755185.1.

Japanese Office Action (and English translation thereof) dated May 19, 2015, issued in counterpart Japanese Application No. 2013-503448.

* cited by examiner

DROPLET DISCHARGE DEVICE AND METHOD FOR DRIVING DROPLET DISCHARGE HEAD

TECHNICAL FIELD

The present invention relates to a droplet discharge device that discharges droplets from nozzles and a method for driving a droplet discharge head.

BACKGROUND

As a conventional example, each of Patent Literatures 1 and 2 discloses a droplet discharge device that detects a droplet speed or a droplet size of droplets discharged from a droplet discharge head and corrects a voltage of a drive signal so that the droplet speed or the droplet size can become a target speed or a target droplet size based on this detection value.

PRIOR ART DOCUMENTS

Patent Documents

Patent Document 1: JP-A-7-256884
Patent Document 2: JP-A-2004-90621

SUMMARY OF THE INVENTION

Problem to be Solved by the Invention

In a droplet discharge device such as an inkjet recording device, to realize high-grade recording, a droplet size must be reduced. As a method for reducing a droplet size, there has been conventionally known use of a "pull striking" system by which a pressure chamber communicating with a nozzle is expanded and then contracted.

On the other hand, a droplet discharge head adopting an inkjet system has unevenness in dimensions of flow paths or characteristics of pressure generating means such as a piezoelectric material, respective nozzles in the same nozzle array have the same droplet speed, but droplet speed largely fluctuates among the nozzle arrays even if the same drive signal is supplied. Further, the droplet speed may fluctuate even in the same nozzle array. Since a fluctuation in droplet size is small, unevenness in droplet speed must be corrected by correcting a voltage of the drive signal.

In case of using the drive method that adopts the above-described "pull striking" system, it was revealed that, when a drive voltage value of an expansion pulse is increased or decreased as a method for correcting a droplet speed, a droplet size largely fluctuates and a problem of a reduction in recording grade occurs.

In view of the above-described problem, it is an object of the present invention to provide a droplet discharge device and a method for driving a droplet discharge head that can suppress a fluctuation in droplet size and correct unevenness of a droplet speed when a drive method adopting the "pull striking" system is used.

Means for Solving Problem

The object according to the present invention can be achieved by the following configuration.

1. A droplet discharge device comprising a droplet discharge head provided with: a plurality of nozzles that discharge droplets; a plurality of pressure chambers communicating with the nozzles; and a plurality of pressure generation units that change a capacity of each pressure chamber by applying a drive signal, wherein the drive signal includes an expansion pulse to expand the capacity of each pressure chamber and a contraction pulse to contract the capacity of each pressure chamber, and the plurality of nozzles are divided into a plurality of groups each comprising one or more nozzles, a drive voltage value of the expansion pulse is set to be common to the respective groups, the drive signal which has a drive voltage value of the contraction pulse independently set in accordance with a droplet speed level for each group is applied to the droplet discharge head, and the droplets are discharged.

2. The droplet discharge device according to 1, wherein the drive voltage value of the contraction pulse is set in such a manner that an absolute value of the drive voltage value of the contraction pulse is increased to substantially equalize the droplet speed for each group as the droplet speed of each group is reduced when the common drive signal is used for drive.

3. The droplet discharge device according to 1 or 2, comprising a storage unit that stores information concerning the drive voltage value of the contraction pulse for each group, wherein the drive voltage value of the contraction pulse is set by making reference to the information stored in the storage unit.

4. The droplet discharge device according to any one of 1 to 3, wherein the plurality of nozzles are aligned in a plurality of arrays and divided to form the plurality of groups in accordance with each array.

5. The droplet discharge device according to any one of 1 to 4, wherein the expansion pulse that is common to the respective groups is used.

6. The droplet discharge device according to any one of 1 to 5, wherein the drive signal comprises: the expansion pulse that expands the capacity of each pressure chamber from a predetermined reference state and then restores it to the reference state; and the contraction pulse that subsequently contracts the capacity of each pressure chamber and then restores it to the reference state.

7. A method for driving a droplet discharge head which discharges droplets from nozzles by applying a drive signal to pressure generation units of the droplet discharge head which comprises: a plurality of nozzles that discharge droplets; a plurality of pressure chambers communicating with the nozzles; and a plurality of pressure generation units that change a capacity of each pressure chamber by applying the drive signal, wherein the drive signal comprises an expansion pulse to expand a capacity of each pressure chamber and a contraction pulse to contract the capacity of each pressure chamber, and the method comprises a discharging process of dividing the plurality of nozzles into a plurality of groups each comprising one or more nozzles, applying to the droplet discharge head the drive signal which has a drive voltage value of the expansion pulse set to be in common to the respective groups and a drive voltage value of the contraction pulse being independently set in accordance with a droplet speed level in each group, and discharging droplets.

8. The method for driving a droplet discharge head according to 7, wherein, in the discharging process, the drive voltage value of the contraction pulse is set in such a manner that an absolute value of the drive voltage value of the contraction pulse is increased to substantially equalize the droplet speed for each group as the droplet speed of each group is reduced when the common drive signal is used for drive.

9. The method for driving a droplet discharge head according to 7 or 8, further comprising a storing process of storing information concerning the drive voltage value of the contraction pulse for each group in a storage unit before the discharging process, wherein, in the discharging process, the drive voltage value of the contraction pulse is set by making reference to the information stored in the storage unit.

10. The method for driving a droplet discharge head according to 9, further comprising, before the storing process, a determining process of applying the drive signal having the fixed drive voltage value of the expansion pulse and the drive voltage value of the contraction pulse changed on a plurality of stages to the droplet discharge head, measuring a droplet speed in accordance with each group, and determining the drive voltage value of the contraction pulse for each group in accordance with a droplet speed level, wherein, in the storing process, information concerning the drive voltage value of the contraction pulse determined for each group in the determining process is stored in the storage unit.

Effect of the Invention

According to the present invention, it is possible to provide the droplet discharge device and the method for driving a droplet discharge head that can suppress a fluctuation in droplet size and correct unevenness of a droplet speed when the drive method adopting the "pull striking" system is used.

DESCRIPTION OF THE PREFERRED EMBODIMENTS

Although embodiments concerning the present invention will now be described hereinafter, the present invention is not restricted thereto.

Embodiments according to the present invention will now be explained hereinafter with reference to the drawings.

<Mechanical Configuration of Inkjet Recording Device>

Figure 1:
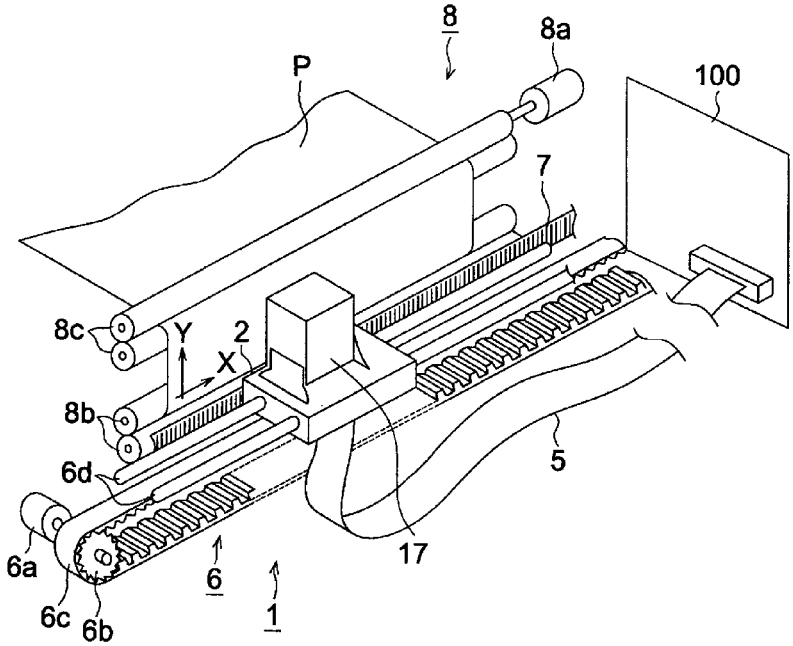
FIG. 1 is a perspective view showing an outline configuration of an inkjet recording device.

FIG. 1 is a view showing an outline configuration of an inkjet recording device 1 to which a droplet discharge device according to the present invention is applied.

A carriage unit 2 is a resin case accommodating a head 17 which is a droplet discharge head, a drive circuit 16 (see FIG. 4) that drives pressure generating means of the head 17, and an ink cartridge (not shown) therein. The drive circuit 16 accommodated in the carriage unit 2 is constituted of an IC, and it is connected to a control board 100 (see FIG. 4) through a flexible cable 5 pulled out of the carriage unit 2.

The head 17 has two nozzle arrays arranged in an X direction which is a main scan direction relative to a recording medium. The number of nozzles is 256 per array, and the nozzles are aligned in a Y direction which is a sub-scan direction. Further, the drive circuit 16 is provided in accordance with each nozzle array.

The number of nozzles per array is not restricted in particular, and it can be determined in accordance with, e.g., a use application of a recording device.

The carriage unit 2 is reciprocated and moved along the main scan direction indicated by an arrow X in the drawing by a carriage unit drive mechanism 6. The carriage unit drive mechanism 6 includes a main scan motor 6*a*, a pulley 6*b*, a toothed belt 6*c*, and a guide rail 6*d*, and the carriage unit 2 is secured to the toothed belt 6*c*.

When the pulley 6*b* rotates by the main scan motor 6*a*, the carriage unit 2 secured to the toothed belt 6*c* is moved along the direction of the arrow X in the drawing. The guide rail 6*d* is formed of two cylinders parallel to each other and inserted into insertion holes in the carriage unit 2 so that the carriage unit 2 can slide.

The ink cartridge has one ink tank therein. An ink supply opening of the ink tank is opened when the ink cartridge is set to the carriage unit 2 and connected to an ink supply pipe, or it is closed when the ink cartridge is disconnected, and an ink having the same composition is supplied to each nozzle array in the head 17 from one ink tank.

The flexible cable 5 is transferring means for transferring image data which is discharge data, a drive signal, and others, and it has a wiring pattern including a data signal line, a power supply line, and others printed on a flexible film, transfers data between the drive circuit 16 and the control board 100, and follows movement of the carriage unit 2.

As will be described later in detail, the drive signal includes an expansion pulse that expands a capacity of a pressure chamber of the head and a contraction pulse that contracts the capacity of the pressure chamber, the two nozzle arrays are divided into two groups in accordance with each array, a drive voltage value of the expansion pulse is set to be common to the respective groups, and a drive voltage value of the contraction pulse is independently set in accordance with each level of a droplet speed in accordance each group.

An encoder 7 has graduations formed on a transparent resin film at predetermined intervals and detects the graduations by using an encoder sensor 126 (an optical sensor) provided in the carriage unit 2, thereby detecting a position of the carriage unit 2.

A recording medium carriage mechanism 8 is a mechanism that carries a recording medium P in the sub-scan direction indicated by an arrow Y in the drawing, and it includes a sub-scan motor 8*a* and carriage roller pairs 8*b* and 8*c*. Each of the carriage roller pair 8*b* and the carriage roller pair 8*c* is a roller pair that is driven by the sub-scan motor 8*a*, and these roller pairs rotate at substantially equal circumferential speeds by a non-illustrated gear train, or the carriage roller pair 8*c* rotates at a slightly higher circumferential speed.

The recording medium P is fed from a paper feed mechanism (not show), then held by the carriage roller pair 8*b* rotated at a fixed speed, and thereafter held and carried by the carriage roller pair 8*c* after correcting its carriage direction to the sub-scan direction by a paper feed guide (not shown).

In this manner, the carriage unit 2 is moved in the main scan direction at the fixed speed while moving the recording medium P in the sub-scan direction at the fixed speed, and an ink discharged from the head 17 is attached, and an image is thereby recorded in a predetermined range on one side of the recording medium P.

<Configuration of Head>

A drive method according to the present invention can be applied to any type of droplet discharge head as long as this head is a droplet discharge head comprising a plurality of nozzles that discharge droplets, a plurality of pressure chambers communicating with the nozzles, a plurality of pressure generating means for changing capacities of the pressure chambers by applying drive signals.

A description will be given as to a shear mode type head in which at least part of a partition wall of each pressure chamber is made of a piezoelectric material and droplets are discharged from nozzles by shear-deforming each partition wall as pressure generating means.

Figure 2:
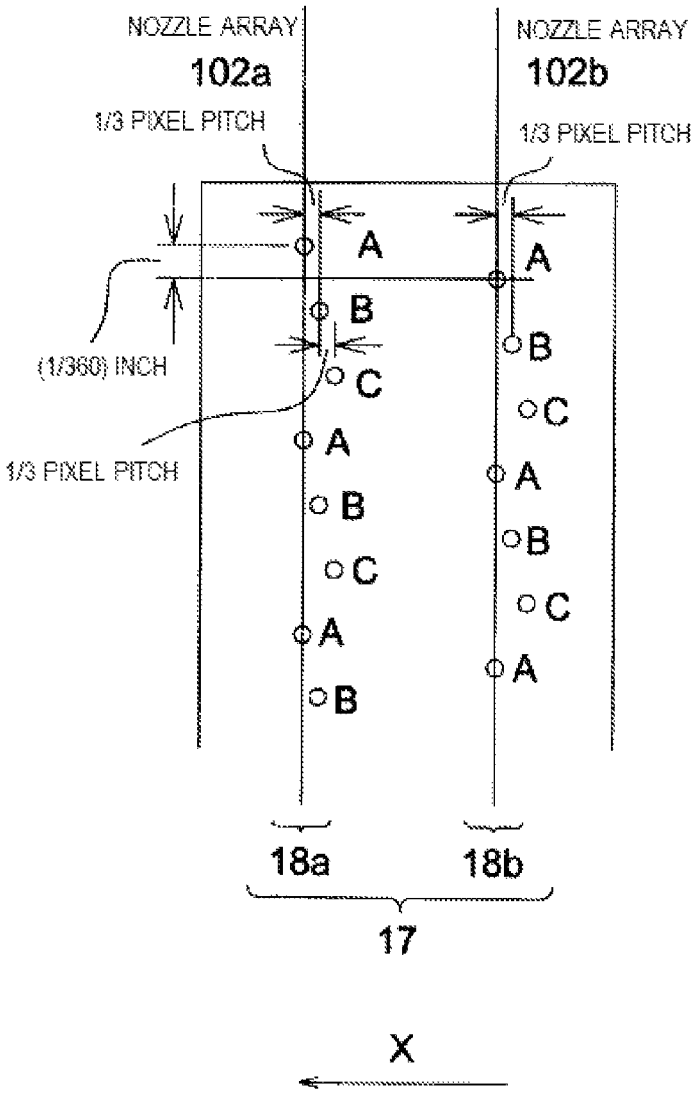
FIG. 2 is an enlarged view of a nozzle unit of a head.

FIG. 2 is an enlarged view of a nozzle unit when the head 17 in FIG. 1 is seen from a direction of the recording medium P. This drawing shows 15 nozzles corresponding to some of 512 nozzles.

The head 17 has a nozzle array 102*a* of nozzles 18*a* and a nozzle array 102*b* of nozzles 18*b* with respect to the main scan direction X for the recording medium.

In case of driving the nozzle array 102*a* or 102*b* having the plurality of pressure chambers partitioned by partition walls at least partially made of a piezoelectric material, when the partition wall of one pressure chamber performs a discharge operation, since an adjacent pressure chamber is affected, the pressure chambers (nozzles) are divided into two or more sets so that pressure chambers (nozzles), which are apart from each other to sandwich one or more pressure chambers (nozzles) therebetween, in the plurality of pressure chambers (nozzles) can collectively form one set, and each set is driven and controlled so that the ink discharge operation is sequentially performed in a time-division manner. This embodiment adopts a so-called three-cycle discharge method by which all the pressure chambers (the nozzles) in one array are divided into three sets by selecting every third pressure chamber.

In this embodiment, each nozzle array is constituted of 256 nozzles, and respective adjacent nozzles of the nozzles in each array are arranged to deviate from each other at ⅓ of a minimum pixel pitch in the main scan direction with a cycle of three nozzles. Every two nozzles in each array are driven in accordance with a discharge period determined by a main scan speed of the head and a deviation amount that is ⅓ of the minimum pixel pitch with three cycles of a set A, a set B, and a set C. As a result, striking positions of droplets discharged from the respective nozzles in the set A, the set B, and the set C are aligned, thereby forming a linear line image in the sub-scan direction.

Furthermore, a nozzle pitch in a nozzle array direction in each array is 180 dpi (141 μm), the two arrays are arranged to be parallel to each other, the nozzles in the respective arrays are deviated from each other by 70.5 μm (corresponding to 360 dpi) in the nozzle array direction, and the entire two arrays constitute a group of 512 nozzles with nozzle density of 360 dpi in the nozzle array direction. That is, nozzle positions of the respective nozzle arrays 102*a* and 102*b* are arranged to deviate from each other in the nozzle array direction so that these nozzle positions can be interpolated in association with an image lattice, thereby recording all pixels by single scan.

The nozzle density is not restricted in particular, and it may be determined in accordance with, e.g., a use application of the recording device.

Figure 3:
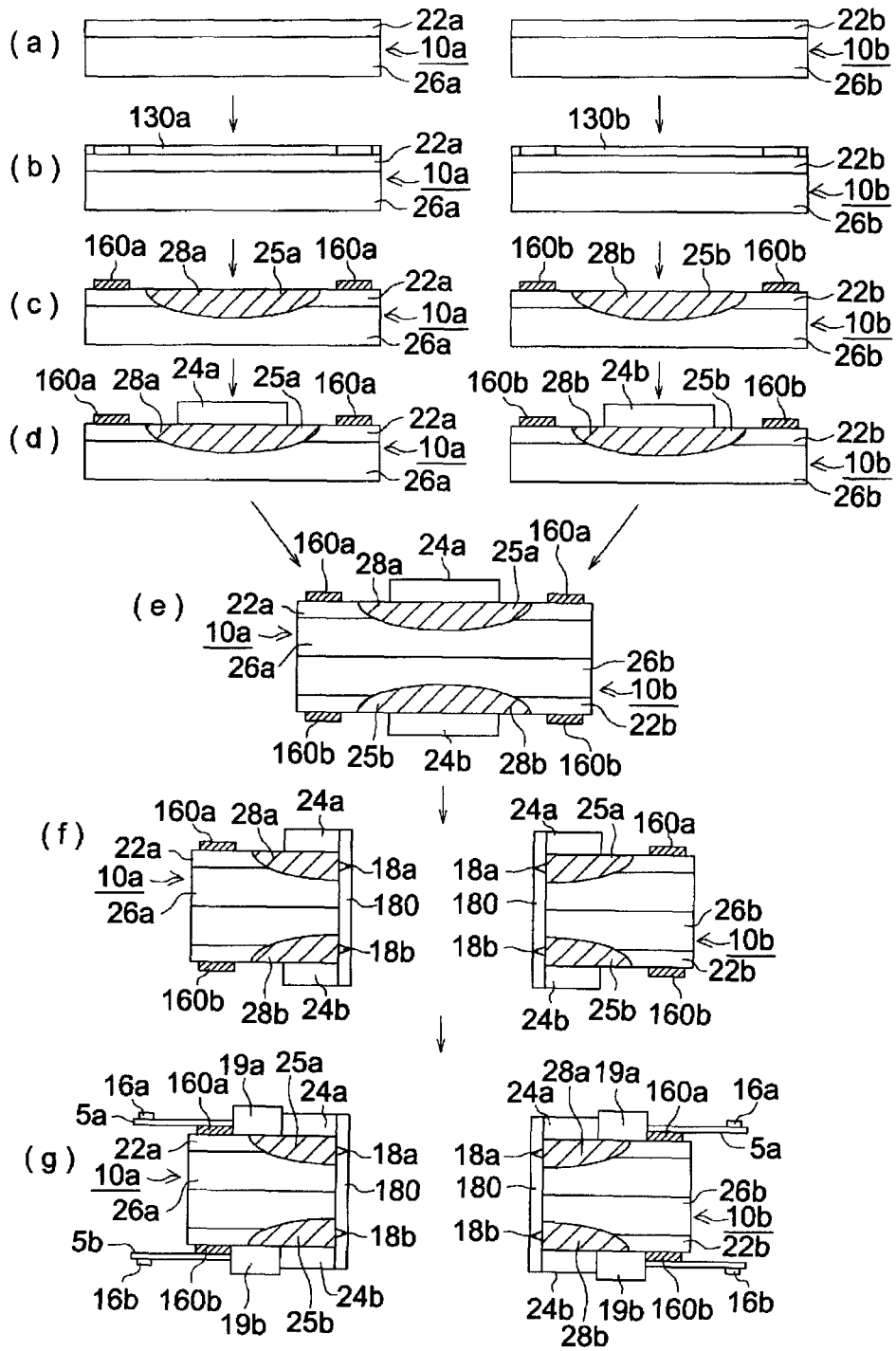
FIGS. 3(*a*)-3(*g*) are schematic views showing a head and a manufacturing process thereof.

FIGS. 3(*a*)-3(*g*) are schematic views showing the shear mode type head 17 and its manufacturing process.

First, a first piezoelectric material substrate 10*a* and a second piezoelectric material substrate 10*b* that have polarization directions different from each other are prepared, the first piezoelectric material substrate 10*a* is formed of a thick substrate 26*a* and a thin substrate 22*a*, and the second piezoelectric material substrate 10*b* is likewise formed of a thick substrate 26*b* and a thin substrate 22*b* (FIG. 3(*a*)).

A dry film 130*a* is attached to an upper side of the thin substrate 22*a* of the first piezoelectric material substrate 10*a*, this dry film 130*a* is subjected to an exposure and development treatment, and a mask that sets each pressure chamber (a channel) or a processing position of an electrode is created (FIG. 3(*b*)). 258 grooves are formed on the first piezoelectric material substrate 10*a* at positions set by the mask with use of a diamond blade or the like, and a pressure chamber 28*a* is formed. As a result, the pressure chambers adjacent to each other are partitioned by a partition wall made of a piezoelectric material. A drive electrode 25*a* is formed in the pressure chamber 28*a* by aluminum evaporation, and extraction electrodes 160*a* connected to this drive electrode 25*a* are formed (FIG. 3(*c*)).

Here, of the 258 pressure chambers, two pressure chambers at both ends are dummy channels through which an ink is not discharged from the nozzles. Although the ink is supplied to the dummy channels, corresponding nozzles are not provided.

Likewise, a dry film 130*b* is attached to an upper side of the thin substrate 22*b* of the second piezoelectric material substrate 10*b*, this dry film 130 is subjected to the exposure and development treatment, a mask that sets each ink pressure chamber or a processing position of each electrode is created. 258 grooves are formed on the second piezoelectric material substrate 10*b* at positions set by the mask with use of a diamond blade or the like, and a pressure chamber 28*b* is formed. As a result, the pressure chambers adjacent to each other are partitioned by a partition wall made of a piezoelectric material. A drive electrode 25*b* is formed in the pressure chamber 28*b* by aluminum evaporation, and extraction electrodes 160*b* connected to this drive electrode 25*b* are formed.

Then, cover substrates 24*a* and 24*b* that cover the pressure chambers 28*a* and 28*b* are provided to the first piezoelectric material substrate 10*a* and the second piezoelectric material substrate 10*b* while avoiding the extraction electrodes 160*a* and 160*b* (FIG. 3(*d*)), the first piezoelectric material substrate 10*a* and the second piezoelectric material substrate 10*b* are attached to each other on the opposite sides of the sides having the cover substrates 24*a* and 24*b* provided thereon and then cut at the central part (FIG. 3(*e*)), and nozzle plates 180 having 256×2 nozzles 18*a* and 18*b* are provided to portions corresponding to the pressure chambers 28*a* and 28*b*, thereby manufacturing two heads 17 (FIG. 3(*f*)).

At the time of attachment, when the substrate are attached in such a manner that the pressure chambers of the respective heads are deviated from each other at a ½ pitch and arranged in a zigzag pattern, deviating pitches of the nozzles by ½ enables use as a head of 360 dpi since each of the heads is a head with 180 dpi, and hence the number of nozzles can be increased to provide high-density heads.

Then, in each of the two heads, manifolds 19*b* and 19*b* that supply the ink to the pressure chambers 28*a* and 28*b* are connected to the first piezoelectric material substrate 10*a* and the second piezoelectric material substrate 10*b*, and flexible cables 5*a* and 5*b* as wiring substrates comprising drive circuits 16*a* and 16*b* are connected to the extraction electrodes 160*a* and 160*b*, thereby simultaneously manufacturing the two heads (FIG. 3(*g*)).

In this embodiment, although the partition wall for the pressure chamber is formed of the thin substrate and the thick substrate as two piezoelectric material substrates having polarization directions different from each other, the piezoelectric material substrate may be, e.g., the thin substrate portion alone, and providing the piezoelectric material substrate to at least part of the partition wall can suffice.

<Electrical Configuration of Entire Inkjet Recording Device>

Figure 4:
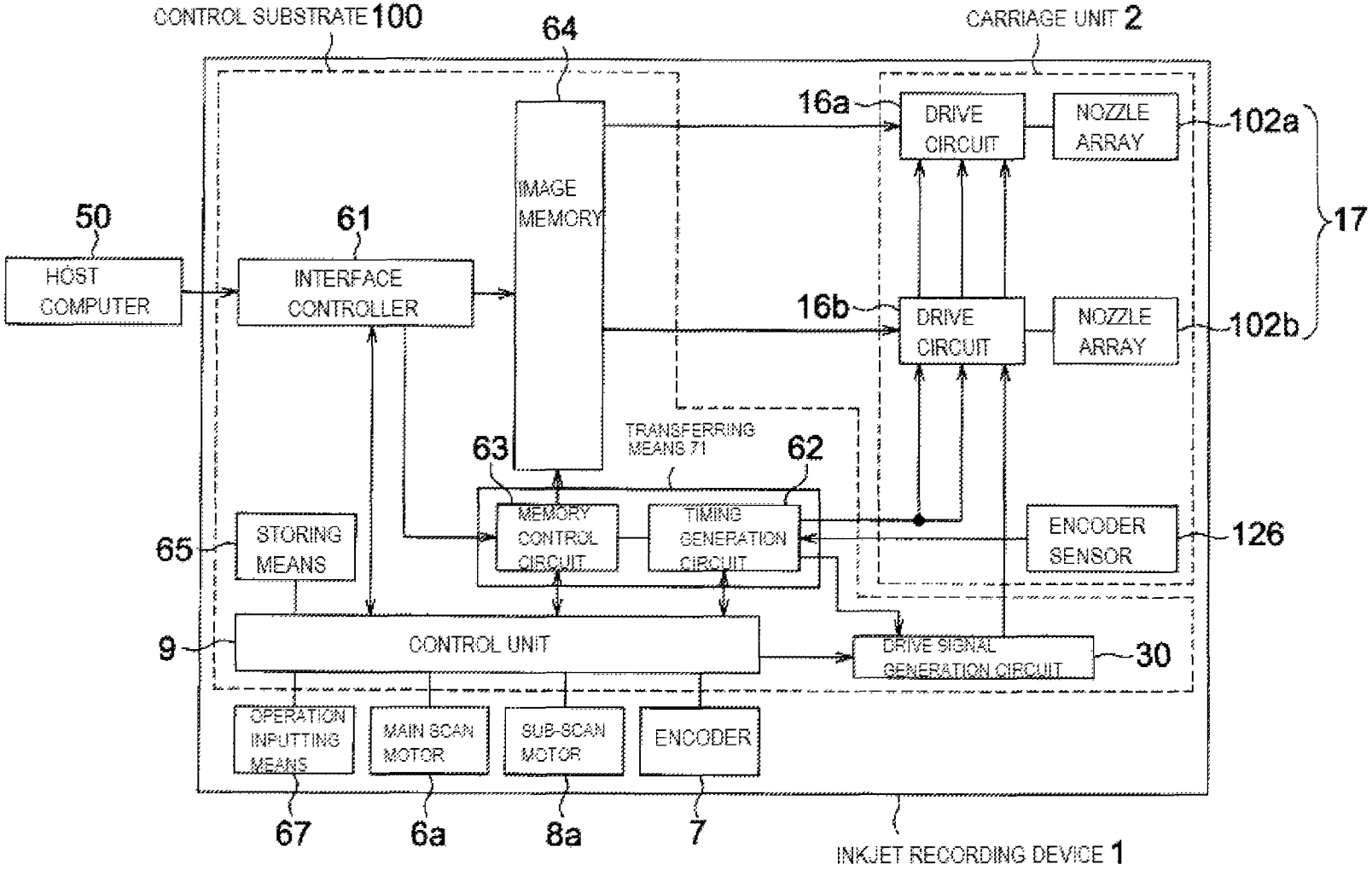
FIG. 4 is a circuit block diagram showing a circuit configuration of the entire inkjet recording device.

FIG. 4 is a block diagram showing an example of an electrical configuration of the entire inkjet recording device according to the embodiment of the present invention depicted in FIG. 1.

In FIG. 4, a control substrate 100 indicated by a broken line has a control unit 9 that controls the entire inkjet recording device 1 mounted thereon, and it is connected to a drive circuit 16 in a carriage unit 2 through the flexible cable 5 as described above.

An interface controller 61 constitutes inputting means for fetching image information from a host computer 50 connected through a communication line.

An image memory 64 temporarily stores the image information acquired through the interface controller 61.

The carriage unit 2 records the image information in the image memory 64 onto the recording medium P. Here, the carriage unit 2 includes the nozzle arrays 102*a* and 102*b* constituting the head 17, the drive circuits 16*a* and 16*b*, and the encoder sensor 126.

The drive circuits 16*a* and 16*b* control discharge timing of droplets in accordance with each of the nozzle arrays 102*a* and 102*b* based on the image information from the image memory 64. In each of the drive circuits 16*a* and 16*b*, a driver that drives the partition wall (pressure generating means) for the pressure chambers associated with the nozzles constituting each nozzle array is present in accordance with each pressure chamber (each nozzle), and the partition wall is driven based on a drive signal from a later-described drive signal generation circuit 30. When the partition wall deforms upon receiving this drive signal, the ink in each pressure chamber is discharged from the nozzle.

Further, the encoder sensor 126 is present on the carriage unit 2 and reads the graduations formed in the main scan direction of the encoder 7 at predetermined intervals. As a result, a position of the carriage unit 2 in the main scan direction is accurately grasped, and appropriate discharge timing of the ink is provided.

Transferring means 71 transfers partial image information recorded by single discharge of the nozzles in each nozzle array from the image memory 64 to the drive circuits 16*a* and 16*b*. The transferring means 71 includes a timing generation circuit 62 and a memory control circuit 63. The timing generation circuit 62 obtains an accurate position of the carriage unit 2 from an output from the encoder sensor 126, and the memory control circuit 63 obtains an address of partial image information required for each nozzle array from this positional information. Further, the memory control circuit 63 uses the address of this partial image information to perform reading from the image memory 64 and transfer to the drive circuits 16*a* and 16*b*.

The main scan motor 6*a* is a motor that moves the carriage unit 2 in the main scan direction shown in FIG. 1. Furthermore, the sub-scan motor 8*a* is a motor that carries the recording medium P in the sub-scan direction.

Storing means 65 is a nonvolatile rewritable memory such as a flash memory, and it stores information concerning a drive voltage value of a contraction pulse of a drive signal in accordance with each nozzle array.

A control unit 9 has a CPU as controlling means for controlling the entire inkjet recording device 1 mounted therein, controls carriage of the recording medium P, movement of the carriage unit 2, discharge of droplets from each nozzle array, and others, and forms target image information on the recording medium P.

Furthermore, operating inputting means 67 has both display and input functions, and it configures various settings including a setting of information concerning a drive voltage value of a contraction pulse of a drive signal for each nozzle array and an instructing operation such as a recording command with respect to the control unit 9.

The drive signal generation circuit 30 drives the nozzle arrays 102*a* and 102*b* and generates a drive signal for discharge droplets. This drive signal is synchronized with a latch signal of image information of the timing generation circuit 62 and generated in accordance with each latch signal.

Figure 5:
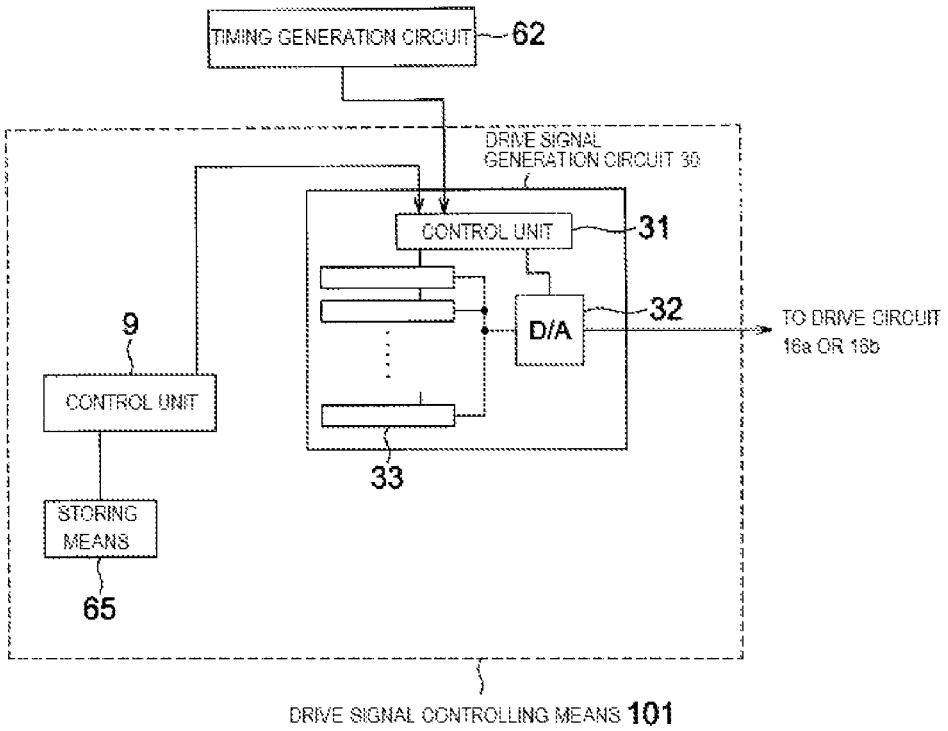
FIG. 5 is a block diagram showing a configuration of drive signal controlling means.

FIG. 5 is a view extracting a configuration of drive signal controlling means 101 according to this embodiment from the above-explained electrical configuration. The drive signal controlling means 101 includes the control unit 9, the storing means 65, and the drive signal generation circuit 30.

The drive signal generation circuit 30 includes a control unit 31, a D/A converter 32, and a plurality of line memories 33. Each line memory 33 is formed of an SRAM or the like, and it stores a drive signal that drives each of the nozzle arrays 102*a* and 102*b*. Moreover, each of the plurality of line memories 33 stores a drive signal having a fixed drive voltage value (a crest value) of an expansion pulse and drive voltage values (crest values) of a contraction pulse that continuously vary by each predetermined amount. The D/A converter 32 converts each drive signal stored in each of the line memories 33 from a digital signal into an analog signal, and transmits it to each of the drive circuits 16*a* and 16*b*.

Additionally, since this embodiment uses a common expansion pulse of the respective drive signals stored in the plurality of line memories 33, the drive signal generation circuit 30 configured to generate drive signals can be simplified, thereby reducing a cost.

It is to be noted that information concerning the drive voltage values of the contraction pulses for each nozzle array, which is stored in the storing means 65, can be obtained by an experiment in advance. For example, if a new head is installed or the head is placed with a new one, the information concerning the drive voltage values of the contraction pulses obtained by the experiment may be stored in a memory or the like mounted in the head 17, and the control unit 9 may read out this information through the flexible cable 5, or the information concerning the drive voltage values of the contraction pulses may be input and set from the operation inputting means 67 or the host computer 50, and the control unit 9 may acquire this information and then store it in the storing means 65.

The control unit 31 selects a line memory 33 based on information, which concerns a drive voltage value of the contraction pulse of each drive signal applied to each of the nozzle arrays 102*a* and 102*b*, from the control unit 9, reads the drive signal from this line memory, and carries out D/A conversion in synchronization with a latch signal of the timing generation circuit 62.

<Drive Signal>

Figure 6:
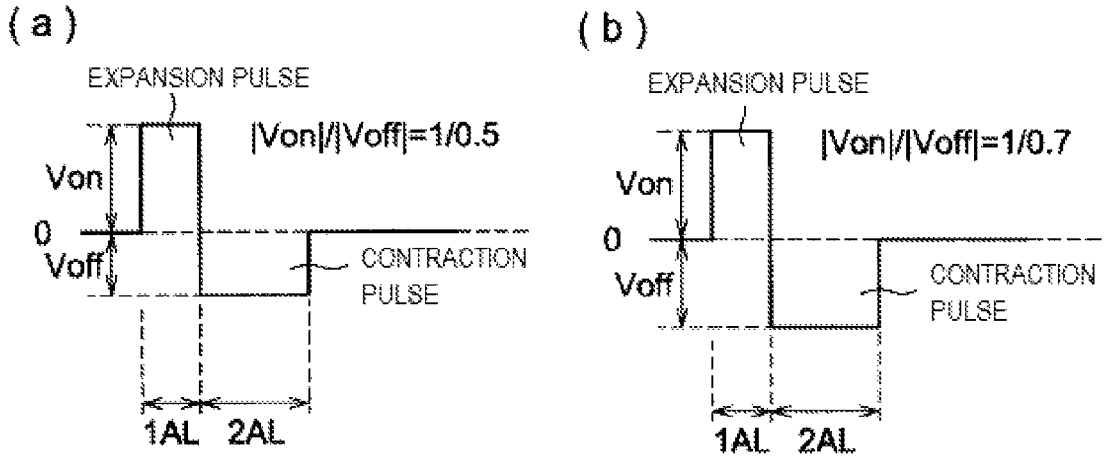
FIGS. 6(*a*) and 6(*b*) are views showing examples of a drive signal of the head.

Here, FIGS. 6(*a*) and 6(*b*) show examples of drive signals stored in the line memory 33. Each drive signal consists of an expansion pulse having a rectangular wave (a positive voltage) and a contraction pulse having a rectangular wave that follows the former pulse.

In this embodiment, since the drive voltage value (the crest value) Von of the expansion pulse is fixed, when the drive voltage value (the crest value) Voff of the contraction pulse is designated, a ratio |Von|/|Voff| of the drive voltage value Von of the expansion pulse and the drive voltage value Voff of the contraction pulse is uniquely determined. Here, |Von| is an absolute value of Von, and |Voff| is an absolute value of Voff.

The drive signal in FIG. 6(*a*) is |Von|/|Voff|=1/0.5, and the same in FIG. 6(*b*) is |Von|/|Voff|=1/0.7. The drive signal in (b) has the same drive voltage value Von of the expansion pulse but has the larger absolute value of the drive voltage value Voff of the contraction pulse with respect to the drive signal in FIG. 6(*a*), thereby enabling correction for increasing a droplet speed.

It is to be noted that, in the drive signal, when a pulse width of the expansion pulse is set to 1 AL, a generated pressure can be more efficiently used to discharge droplets, which is preferable. Moreover, an edge at a rear end of the contraction pulse has a function of canceling reverberation of pressure waves remaining in each pressure chamber after discharging droplets, and setting a pulse width of the contraction pulse to 2 AL enables appropriately canceling the reverberation of the pressure waves, which is preferable.

It is to be noted that AL (Acoustic Length) means ½ of an acoustic resonant period of each pressure chamber.

It is to be noted that the drive signal explained herein is just an example, and the present invention is not restricted to this type of drive signal. The expansion pulse and the contraction pulse are not restricted to the rectangular waves, and they may have a slope waveform or an arbitrary analog waveform. Additionally, the rectangular wave described herein means a waveform that both a rising time that is 10% to 90% of the drive voltage value (the crest value) and a falling time that is 90% to 10% of the drive voltage value (the crest value) correspond to ⅕ or preferably 1/10 or less of the acoustic resonant period of the pressure chamber.

Further, a reference voltage of the drive voltage value Von of the expansion pulse and the drive voltage value Voff of the contraction pulse is not necessarily 0. Each of Von and Voff is a voltage corresponding to a difference from the reference voltage. It is to be noted that, since the reference voltage is set to a GND level in this embodiment, the voltage can be reduced, and reducing the drive voltage enables suppressing deterioration of the piezoelectric material (PZT) and also enables greatly fluctuating a pressure in each pressure chamber even though the drive voltage is low.

Furthermore, when a state maintained at this reference voltage is determined as a reference state, like this embodiment, it is preferable for the drive signal to have an expansion pulse that expands a capacity of each pressure chamber from the predetermined reference state and then restoring the reference state and a contraction pulse that subsequently contracts the capacity of each pressure chamber and the restoring the reference state. Since voltages at a start point and an end point of the discharge pulse consisting of the expansion pulse and the contraction pulse (the reference voltage) can be uniformed, an unnecessary signal for restoring the voltage at the time of continuously generating the discharge pulse does not have to be added.

Moreover, it is preferable for each pressure chamber in the reference state to be in a reference capacity state which is neither an expanded state nor a contracted state.

<Drive Method>

A method for driving the head will now be described.

Although the method for driving one nozzle array in the head 17 will be explained herein, this method can be also applied to the other nozzle array.

Figure 7:
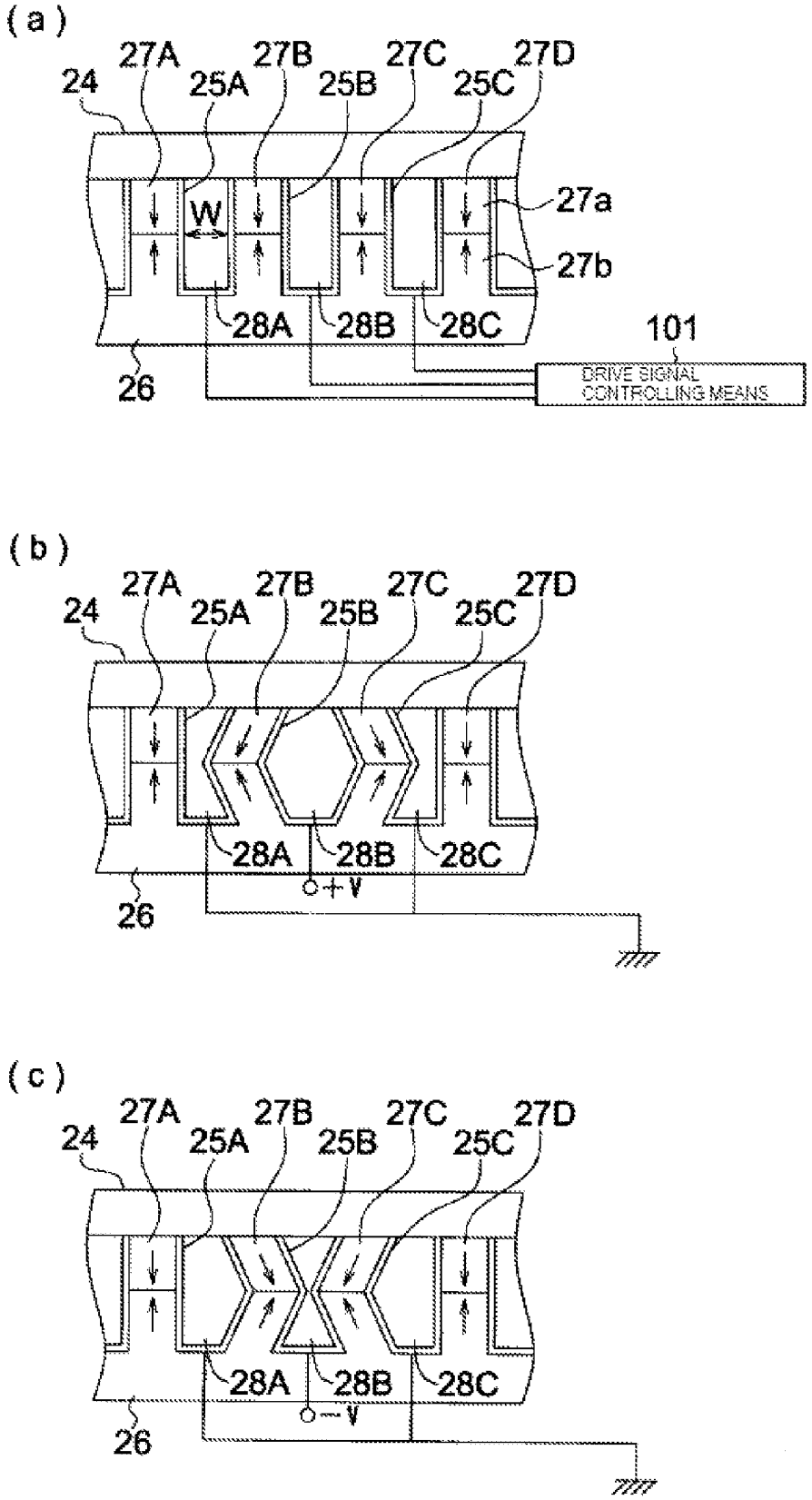
FIGS. 7(*a*)-7(*c*) are views showing operations of the head.

FIGS. 7(*a*)-7(*c*) are views showing an operation at the time of discharging the ink. FIGS. 7(*a*)-7(*c*) show three chambers (28A, 28B, 28C) corresponding to part of 256 pressure chambers 28, and these chambers are partitioned by a plurality of partition walls 27A, 27B, 27C, and 27D made of a piezoelectric material between the cover substrate 24 and the substrate 26.

Additionally, each electrode 25A, 25B, or 25C that is connected from the upper side of both partition walls 27 over a bottom surface of the substrate 26 is formed on a surface of the partition walls 27 in each pressure chamber 28 in a close contact manner, and each electrode 25A, 25B, or 25C is connected to the drive signal controlling means 101 through the dive circuit 16*a* or 16*b*.

Each partition wall 27 is made of two piezoelectric materials 27*a* and 27*b* having different polarization directions as indicated by arrows in FIGS. 7(*a*)-7(*c*) but, for example, the portion denoted by reference sign 27*a* alone may be provided as the piezoelectric material, and providing this material to at least part of the partition wall 27 can suffice.

When such a drive signal as shown in FIGS. 6(*a*) and 6(*b*) is applied to each electrode 25A, 25B, or 25C formed on the surface of each partition wall 27 in a close contact manner under control of the drive signal controlling means 101, droplets are discharged from the nozzles 18 by an operation illustrated below. It is to be noted that the nozzles are omitted in FIGS. 7(*a*)-7(*c*).

First, in a state shown in FIG. 7(*a*), when the electrodes 25A and 25C are grounded and the expansion pulse as a rectangular wave of a positive voltage having a width 1 AL is applied to the electrode 25B, electric fields in directions perpendicular to the polarization directions of the piezoelectric materials constituting the partition walls 27B and 27C are generated, a joint surface of the partition walls 27*a* and 27*b* of each of the partition walls 27B and 27C undergoes shear deformation, the partition walls 27B and 27C deform toward the outside as shown in FIG. 7(*b*), the capacity of the pressure chamber 28B expands, a negative pressure is produced in the pressure chamber 28B, and the ink flows into this pressure chamber.

When this state is maintained for 1 AL, since the pressure is changed to a positive pressure, restoring a potential to 0 at this timing enables the partition walls 27B and 27C to return to a neutral position shown in FIG. 7(*a*) from an expanded position depicted in FIG. 7(*b*), and a high pressure is applied to the ink in the pressure chamber 28B. Furthermore, when the contraction pulse as a rectangular wave of a negative voltage having a width 2 AL is applied to the electrode of the pressure chamber at the same timing, the partition walls 27B and 27C deform in the opposite direction as shown in FIG. 7(*c*), and the capacity of the pressure chamber 28B is decreased, and a higher pressure is thereby applied to the ink. As a result, an ink meniscus in the nozzle caused due to part of the ink filling the pressure chamber 28B changes to a direction along which the ink is pushed out from the nozzle. When this positive pressure increases to discharge droplets from each nozzle, the droplets are discharged from the nozzle. The pressure is reversed after 1 AL, a negative pressure is formed in the pressure chamber 28, the pressure in the pressure chamber 28 is revered reversed after elapse of another 1 AL, a positive pressure is formed in the pressure chamber 28, and hence resetting the potential to 0 at this timing enables correcting the deformation of the partition walls, thereby canceling the remaining pressure waves.

To drive the shear mode type head having the plurality of pressure chambers, drive is carried out with three cycles, i.e., the set A, the set B, and the set C as described above.

Figure 8:
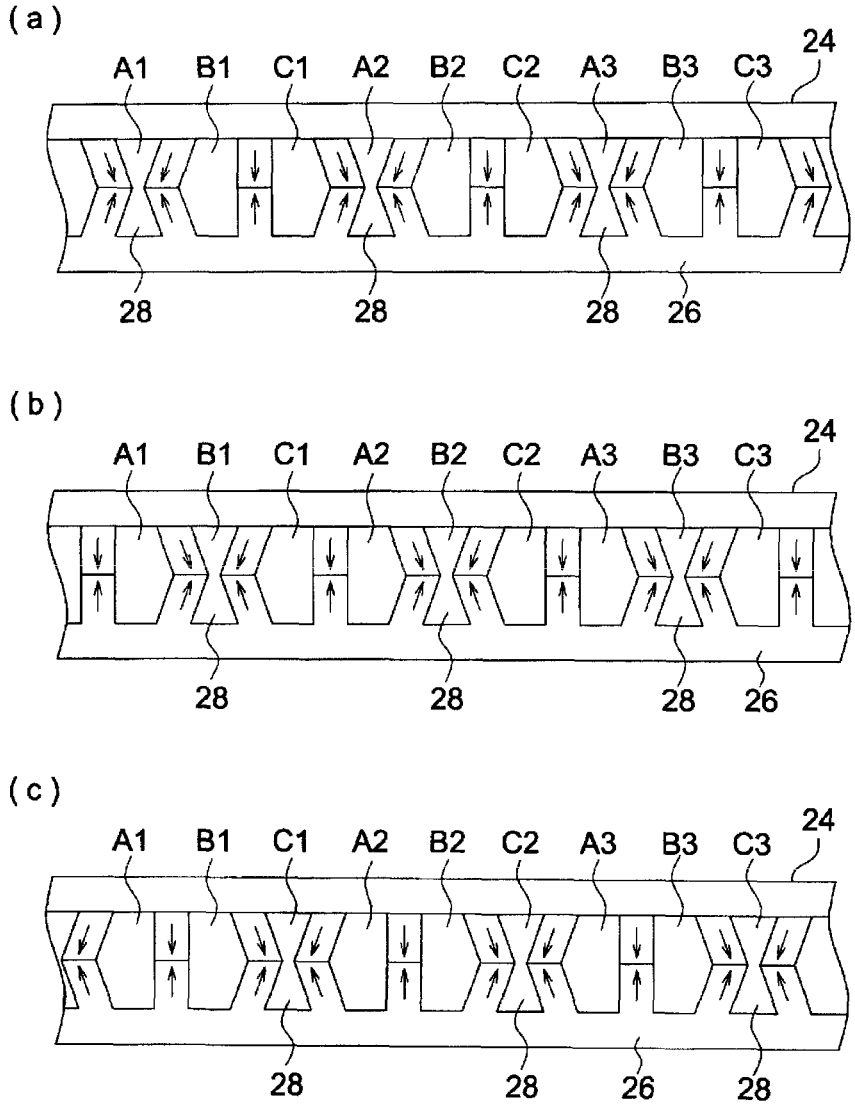
FIGS. 8(*a*)-8(*c*) are explanatory views of a time-division operation of the head.

The three-cycle discharge operation will now be further described with reference to FIGS. 8(*a*)-8(*c*) and FIG. 9. FIGS. 8(*a*)-8(*c*) are views showing a divided drive operation of the shear mode head, and this drawing shows a state that the capacity of each pressure chamber is contracted and also shows nine pressure chambers A1, B1, C1, A2, B2, C2, A3, B3, and C3 which are part of 256 pressure chambers in one array.

Figure 9:
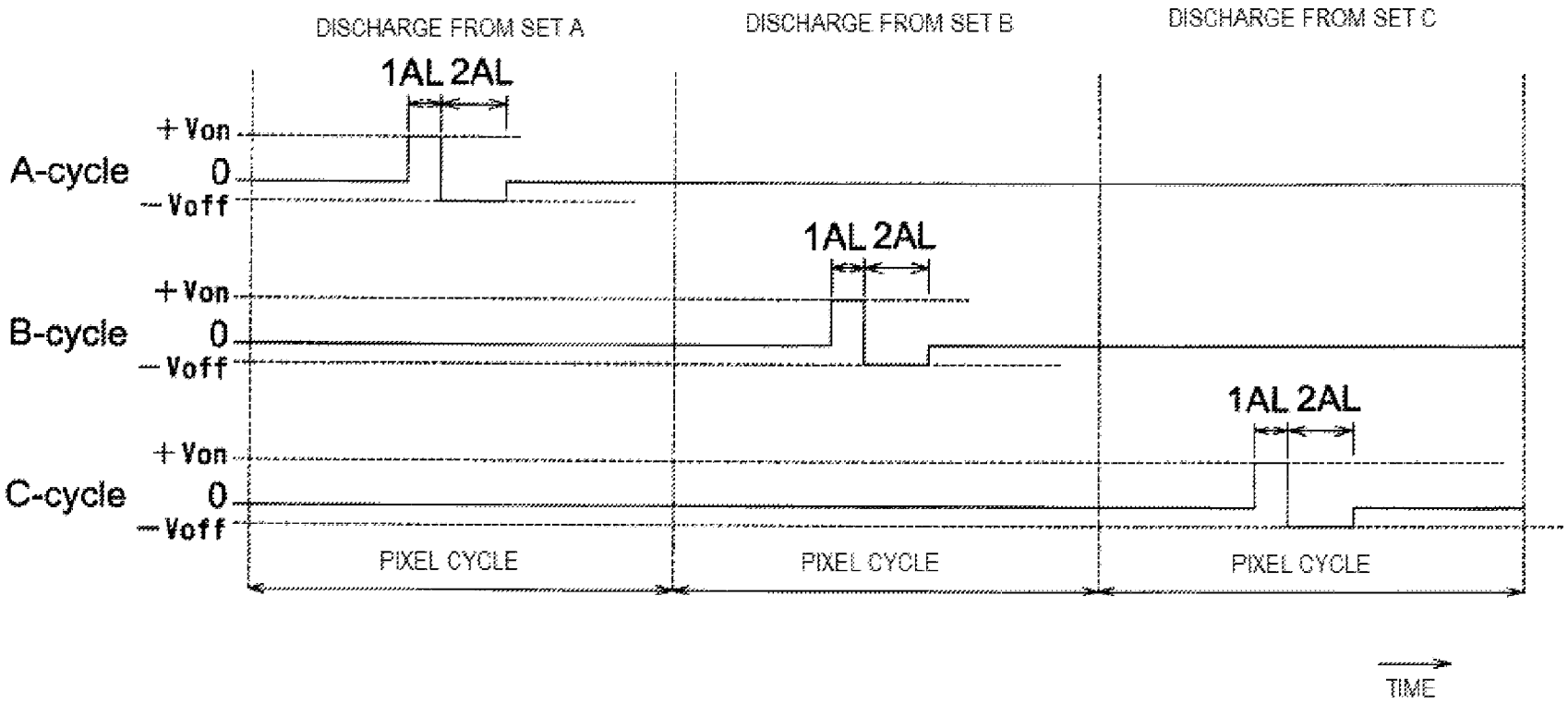
FIG. 9 is a timing chart of a drive signal applied to an electrode of each pressure chamber in each of sets A, B, and C.

Additionally, FIG. 9 shows a timing chart of the drive signal applied to each pressure chamber 28 in each of the sets A, B, and C at this time.

At the time of discharging the ink, first, the drive signal is applied to the electrode of each pressure chamber 28 in the set A in accordance with image data.

Subsequently, the same operation is performed with respect to each pressure chamber 28 in the set B and then each pressure chamber 28 in the set C.

Figure 10:
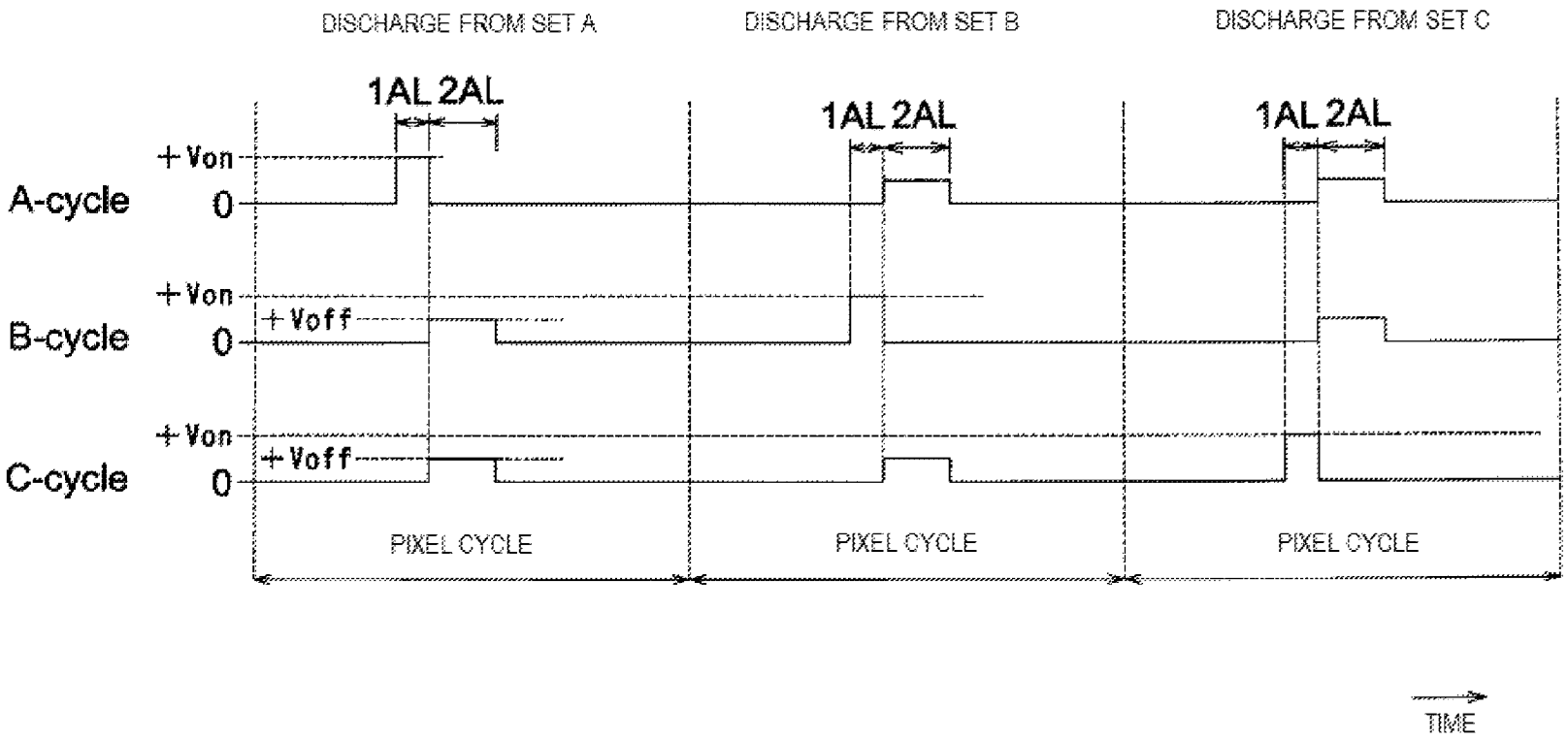
FIG. 10 is a timing chart of the drive signal when a positive voltage alone is used.

In this shear mode head, since each partition wall deforms due to a difference between voltages applied to the electrodes provided on both sides of the wall, the same operation can be performed by grounding the electrode of each pressure chamber from which the ink is discharge and applying a positive pressure to the electrodes of the pressure chambers provided on both sides of the former pressure chamber as shown in FIG. 10 in place of applying a negative voltage to the electrode of the pressure chamber from which the ink is discharged. According to this method, since the drive can be carried out with use of the positive voltage alone, which is a preferred embodiment.

Before explaining an operation of the drive signal controlling means 101 according to this embodiment, a relationship between the drive voltage value of the drive signal, a droplet size, and a droplet speed will now be described.

The droplets of the ink discharged from the nozzles play an important role for determining image quality of an image formed on the recording medium P. First, unevenness in droplet size causes unevenness in dot area constituting a pixel formed on the recording medium P, thereby leading to a reduction in image quality.

Further, as shown in FIG. 1, the droplets are discharged from the head 17, which moves in the main scan direction at a fixed speed, at a position apart from the recording medium P by a predetermined length. Therefore, the unevenness in droplet speed causes the unevenness in striking position of the droplets on the recording medium P, thus resulting in a reduction in image quality.

On the other hand, an inkjet type droplet discharge head has unevenness in dimension of a flow path, characteristics of pressure generating means such as a piezoelectric material, and others, droplets from respective nozzles in the same nozzle array have the same speed, but the droplet speed greatly fluctuates among the nozzle arrays even though the same drive signal is supplied. Furthermore, the droplet speed may fluctuate in the same nozzle array in some cases. Since a fluctuation of a droplet size is small, a voltage of the drive signal must be corrected to correct the unevenness of the droplet speed.

In this embodiment, although the respective nozzles in the nozzle array 102*a* or 102*b* of the head 17 have the uniform droplet speed, the droplet speeds of the nozzle arrays 102*a* and 102*b* are greatly different from each other even if the same drive signal is applied.

Here, if the drive method adopting the "pull striking" system is used, the method for correcting the droplet speed has the following problem in case of increasing or decreasing the drive voltage value of the expansion pulse.

When the drive voltage value of the expansion pulse is increased to raise and correct the droplet speed, a meniscus pulling amount and a moving speed thereof increase, and the droplet speed increases substantially in proportion to the voltage. However, since the increase in voltage raises the pulling amount of the meniscus formed in the nozzle, the droplet size is reduced in proportion to the voltage. Contrarily, when the drive voltage value of the expansion pulse is decreased to reduce and correct the droplet speed, the meniscus pulling amount and the moving speed thereof are decreased, and the droplet speed is reduced substantially in proportion to the voltage. However, since the decrease in voltage reduces the pulling amount of the meniscus formed in the nozzle, the droplet size increases in proportion to the voltage.

As can be assumed from the above-described phenomenon, when the drive voltage value of the expansion pulse is corrected to adjust the droplet speed, the droplet speed can be maintained constant, but the droplet size greatly fluctuates, resulting in a problem of a reduction in recording grade.

In this embodiment, since the common drive voltage value of the expansion pulse is set for the nozzle arrays and the drive voltage value of the contraction pulse is set to differ in accordance with a level of the droplet speed in accordance with each nozzle array, a fluctuation in droplet size can be suppressed, and unevenness of the droplet speed can be corrected.

An operation of the drive signal controlling means 101 will now be described. First, the control unit 9 acquires information concerning a drive voltage value Voff-a or Voff-b of the contraction pulse of each of the nozzle arrays 102*a* and 102*b* from the storing means 65. Here, each of Voff-a and Voff-b is a value that is experimentally determined.

In this embodiment, the information concerning the drive voltage values Voff-a and Voff-b of the contraction pulse determined so that the droplet speeds of the nozzle arrays 102*a* and 102*b* can be substantially equal to each other is stored.

Here, being substantially equal means that a difference between the droplet speeds of the nozzle arrays 102*a* and 102*b* falls within the range of 0.1 m/s or less. Moreover, the droplet speed when the plurality of nozzles are provided in one nozzle array like this embodiment means an average value of droplet speeds of respective droplets discharged from the respective nozzles. Since each of the nozzle arrays 102*a* and 102*b* includes 256 nozzles, an average value of the droplet speeds of respective droplets discharged from the 256 nozzles is determined as the droplet speed of each nozzle array.

Additionally, when three or more nozzle arrays are provided, a situation that droplet speeds are substantially equal means that a difference between a maximum value and a minimum value of droplet speeds of the respective nozzle arrays falls within the range of 0.1 m/s or less.

Then, the control unit 9 determines the drive voltage values from the acquired information. Further, the control unit 9 transmits the determined drive voltage values Voff-a and Voff-b to the control unit 31 of the drive signal generation circuit 30.

Subsequently, the control unit 31 selects memory lines having the corresponding voltage values from the plurality of memory lines 33 based on the voltage value information Voff-a and Voff-b. Moreover, the control unit 31 performs D/A conversion in synchronization with a latch signal from the timing generation circuit 62 and outputs analog drive signals to the drive circuits 16*a* and 16*b*.

How to obtain Voff-a and Voff-b will now be described.

Figure 11:
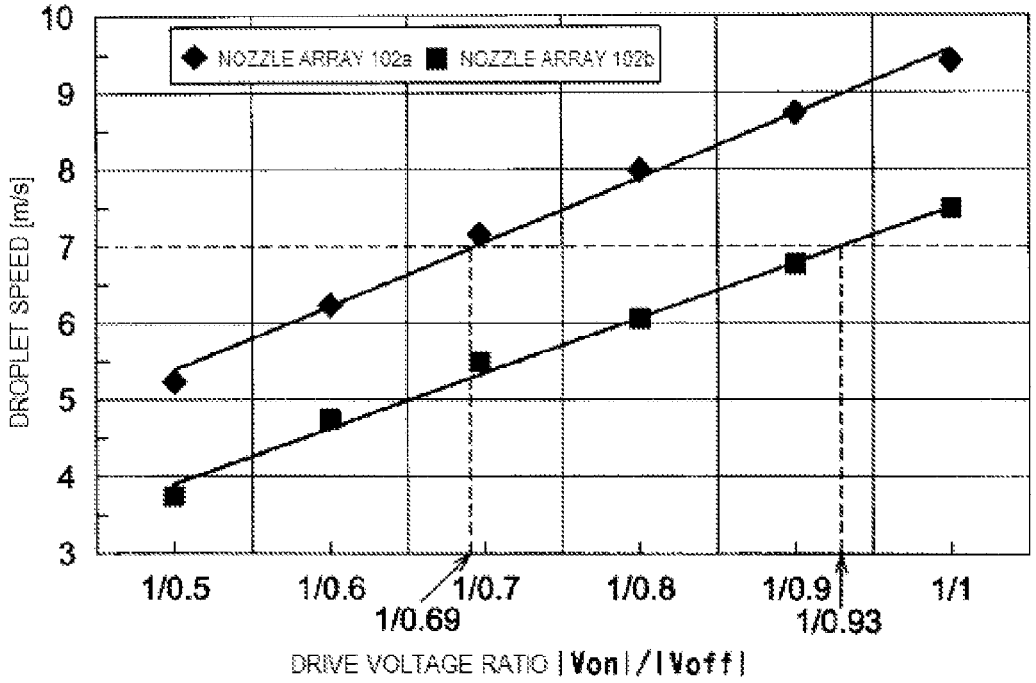
FIG. 11 is a view showing an example of a relationship between a drive voltage ratio and a droplet speed when a drive voltage value of a contraction pulse is changed.
Figure 12:
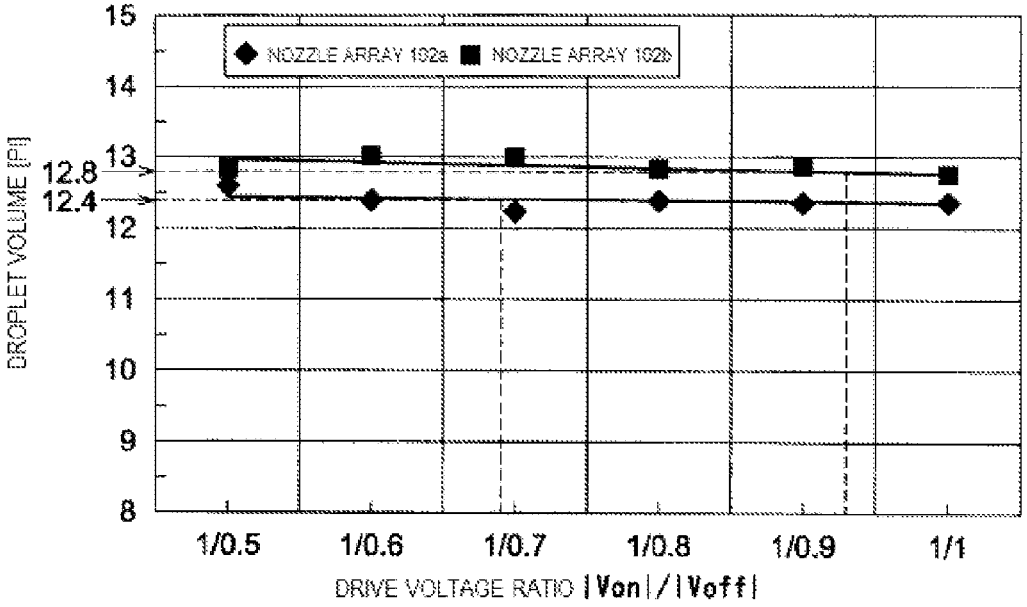
FIG. 12 is a view showing an example of a relationship between a drive voltage ratio and a droplet volume (a droplet size) when a drive voltage value of a contraction pulse is changed.

Each of FIG. 11 and FIG. 12 shows a relationship between the drive voltage value Voff of the contraction pulse, the droplet speed, and a droplet volume (the droplet size) with respect to each of the nozzle arrays 102*a* and 102*b* in the shear mode type head shown in FIG. 2.

Specifically, the ink having the same composition was supplied to each nozzle array of the head 17 from one ink tank, the pressure chambers in each nozzle array were divided into three groups based on the drive signals shown in FIG. 9, and the three-cycle drive was carried out. In regard to droplet speed measurement, strobe measurement using a CCD camera was conducted, a droplet speed at the moment that a droplet traveled approximately 1 mm from the nozzle opening was measured, and average values of droplet speeds and droplet volumes of the 256 nozzles in each array were determined as a droplet speed and a droplet volume of this nozzle array. Unevenness of the droplet speed and the droplet volume of the respective droplets discharged from the respective 256 nozzles corresponding to one array was hardly observed.

At the time of experimentally determining Voff-a and Voff-b, it is preferable to apply drive signals each having a fixed drive voltage value of the expansion pulse and a drive voltage value of the contraction pulse changed on a plurality of stages to each nozzle array, measure droplet speeds, and determine the drive voltage values Voff-a and Voff-b of the contraction pulse adjusted for each of the nozzle arrays so that the droplet speeds of the respective nozzle arrays can become substantially equal to each other based on the measurement results.

The drive signals are set to meet standard conditions in advance, a drive voltage value Von of the expansion pulse at this time is set to 12 V, and a drive voltage value Voff of the contraction pulse is likewise set to −6 V. Then, based on Von=12 V (a fixed value), Voff is increased or decreased (six standards, i.e., −6 V, −7.2 V, −8.4 V, −9.6 V, −10.8 V, and −12 V), and FIG. 11 shows a relationship between |Von|/|Voff| and the droplet speed at this moment whilst FIG. 12 shows a relationship between |Von|/|Voff| and the droplet volume at this moment.

Figure 13:
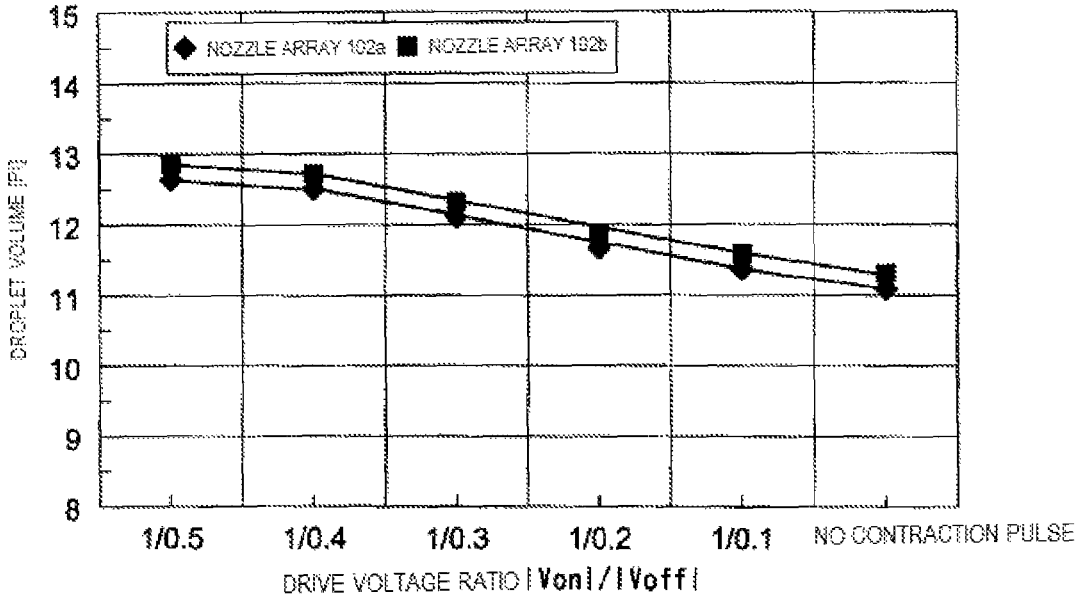
FIG. 13 is a view showing an example of a relationship between a drive voltage ratio and a droplet volume (a droplet size) when a drive voltage value of an expansion pulse is changed.

Further, FIG. 13 shows |Von|/|Voff| and the droplet volume when Von is increased or decreased (six standard, i.e., 12 V, 15 V, 20 V, 30 V, 60 V, and 0 V (with no contraction pulse)) based on Voff=−6 V (a fixed value).

As can be understood from FIG. 11, the nozzle array 102*a* has a higher droplet speed when driven with the same drive signal than that of the nozzle array 102*b*. If a difference between the droplet speeds of the nozzle arrays 102*a* and 102*b* is to be corrected by using the drive voltage value Voff of the contraction pulse, Voff of each of the nozzle arrays 102*a* and 102*b* must be changed and, for example, in order to set a target droplet speed to 7 m/s, the nozzle array 102*a* has |Von|/|Voff|=1/0.69 and Voff=−8.3 V whilst the nozzle array 102*b* has |Von|/|Voff|=1/0.93 and Voff=−11.2 V, the nozzle array 102*a* has a droplet volume of 12.4 pl whilst the nozzle array 102*b* has a droplet volume of 12.8 pl at this moment as can be seen from FIG. 12, and hence a fluctuation range is small. On the other hand, as can be understood from FIG. 13, if correction is to be carried out by using each drive voltage value Von of the expansion pulse, changing Von of each of the nozzle arrays 102*a* and 102*b* results in a large fluctuation range of each droplet volume.

That is, at the time of correcting each droplet speed, controlling each drive voltage value of the contraction pulse is more effective, and a fluctuation in droplet volume can be reduced.

It can be assumed that such phenomena occur since a pulling amount of the meniscus in each nozzle increases at the start of discharge when the drive voltage value of the expansion pulse is raised, whereby the droplet volume is reduced. On the other hand, since the drive voltage value of the contraction pulse does not affect a meniscus position at the start of discharge, it can be considered that the droplet volume hardly varies.

Figure 14:
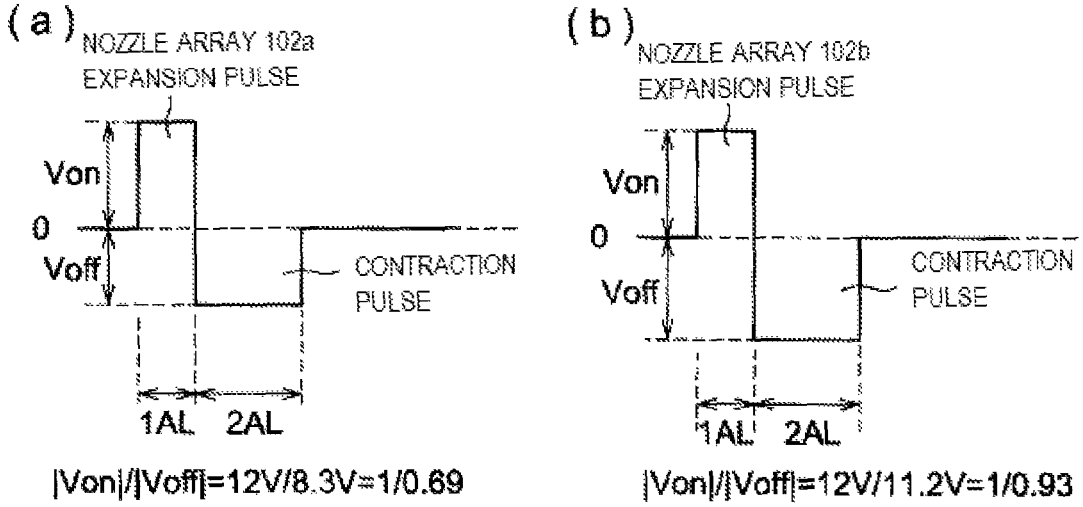
FIGS. 14(*a*) and 14(*b*) are views showing an example of a drive signal applied to each nozzle array.

In this embodiment, Voff-a=−8.3 V which is the drive voltage value of the contraction pulse of the nozzle array 102*a* and Voff-b=−11.2 V which is the drive voltage value of the contraction pulse of the nozzle array 102*b* are stored in the storing means 65, and the drive signal controlling means 101 generates a drive signal shown in FIG. 14(*a*) for the nozzle array 102*a* and a drive signal shown in FIG. 14(*b*) for the nozzle array 102*b* by making reference to this information. That is, since the drive voltage value Von of the expansion pulse is set to be common to the respective nozzle arrays and the drive signal obtained by adjusting the drive voltage value Voff in accordance with a level of the droplet speed of each nozzle array is generated and applied to each nozzle array, a fluctuation in droplet volume can be suppressed, and unevenness of the droplet speed can be corrected in the case where the drive method adopting the "pull striking" system is used.

Furthermore, since the common expansion pulse of the drive signal applied to each nozzle array is used, pulling the meniscus can be stably controlled, and a fluctuation in droplet volume can be suppressed.

Although the description has been given as to the situation where the inkjet recording device adopts the serial head system in the foregoing embodiment, the present invention can be also applied to a case where the inkjet recording device adopts a line head system.

Moreover, in this embodiment, the plurality of nozzles are arranged in the plurality of arrays, the nozzles in each array are divided into the plurality of groups, and the drive voltage value of the contraction pulse of the drive signal is set in accordance with each nozzle array, but the plurality of nozzles can be divided into a plurality of groups each consisting of one or more nozzles, a drive voltage value of an expansion pulse can be set in common to the respective groups, a drive voltage value of a contraction pulse can be independently set in accordance with a level of a droplet speed in accordance with each group, a method for dividing the nozzles into the plurality of groups can be appropriately set in accordance with unevenness of the droplet speed, and it is not restricted in particular. For example, when the droplet speed fluctuates even in the same nozzle array, the plurality of nozzles in one array may be divided into a plurality of groups each consisting of one or more nozzles.

Moreover, in this embodiment, as the droplet discharge head, one head having the plurality of nozzle arrays formed at a predetermined interval is provided, but a plurality of unit heads (separable independent heads) each having one nozzle array formed therein may be provided to obtain a plurality of droplet discharge heads, and the unit heads may be divided into a plurality of groups, for example. Additionally, the droplet discharge head may be configured to include the plurality of unit heads each having at least one nozzle.

Further, in the foregoing embodiment, the shear mode type piezoelectric material that deforms in the shear mode by applying an electric field is used as the pressure generating means. The shear mode type piezoelectric material can more effectively use drive pulses having rectangular waves, the drive voltage value can be lowered, and more efficient drive is enabled, which is preferable. Furthermore, although the example of the head in which the pressure chambers are continuous to interpose each partition wall therebetween has been explained, the present invention can be also applied to a dummy channel type head in which pressure chambers and dummy channels (air chambers) are alternately aligned, the pressure chambers are arranged in an alternating manner, and an ink is discharged from the pressure chambers. In this case, even if the partition wall of each pressure chamber undergoes shear deformation, the other adjacent dummy channels are not affected, and each pressure chamber can be easily driven.

However, the present invention is not restricted thereto, and it is possible to use a piezoelectric material as another conformation such as a single-plate type piezoelectric actuator or a longitudinal vibration type stacked piezoelectric material as the piezoelectric material. Additionally, it is also possible to use any other pressure generating means such as an electromechanical conversion device utilizing electrostatic force or magnetic force or an electrothermal conversion device configured to apply a pressure utilizing a boiling phenomenon.

Further, although the application example of the inkjet recording device as the droplet discharge device has been explained above and the head configured to perform image recording is used as the droplet discharge head in the above description, the present invention is not restricted thereto, and it can be extensively applied as a droplet discharge head and a droplet discharge device each of which is constituted of a plurality of nozzles configured to discharge droplets, a plurality of pressure chambers communicating with the nozzles, and a plurality of pressure generating means for changing a volume of each pressure chamber by applying a drive signal. For example, the present invention is effective for industrial purposes such as a purpose of fabricating a liquid crystal color filter.

EXPLANATIONS OF LETTERS OR NUMERALS

1 inkjet recording device (droplet discharge device)
2 carriage unit
5 flexible cable
9 control unit
10, 10*a*, 10*b* piezoelectric material substrate
16, 16*a*, 16*b* drive circuit
17 head (droplet discharge head)
18, 18*a*, 18*b* nozzle
19, 19*a*, 19*b* manifold
24, 24*a*, 24*b* cover substrate
25, 25*a*, 25*b*, 25A, 25B, 25C drive electrode
28, 28*a*, 28*b*, 28A, 28B, 28C pressure chamber
65 storing means
100 control substrate
101 drive signal controlling means
102, 102*a*, 102*b* nozzle array
180 nozzle plate
X main scan direction
Y sub-scan direction

The invention claimed is:

1. A droplet discharge device comprising:

a drive signal generation circuit which generates a drive signal; and a droplet discharge head which includes:

a plurality of nozzles that discharge droplets;

a plurality of pressure chambers communicating with the nozzles; and a plurality of piezoelectric material substrates that change a capacity of each pressure chamber by application of the drive signal which is generated by the drive signal generation circuit, wherein:

the drive signal generation circuit is configured to generate the drive signal which includes an expansion pulse to expand the capacity of each pressure chamber and a contraction pulse to contract the capacity of each pressure chamber, the plurality of nozzles are divided into a plurality of nozzle groups each comprising one or more nozzles and corresponding to the piezoelectric material substrates, the drive signal generation circuit is configured to generate the drive signal such that a drive voltage value Von of the expansion pulse is set to be common to the respective groups and such that a drive voltage value Voff of the contraction pulse is independently set in accordance with a droplet speed level for each group, the drive signal is applied to the droplet discharge head, and the droplets are discharged, the expansion pulse expands the capacity of each pressure chamber from a predetermined reference state and then restores the capacity to the reference state, and the contraction pulse subsequently contracts the capacity of each pressure chamber and then restores the capacity to the reference state, and the drive voltage value Von of the expansion pulse and the drive voltage value Voff of the contraction pulse are set such that $|Von|/|Voff|$ is not less than 1 and not more than 2, where the drive voltage value Von of the expansion pulse is a voltage corresponding to a difference from a reference voltage applied in the reference state, and the drive voltage value Voff of the contraction pulse is a voltage corresponding to a difference from the reference voltage.

2. The droplet discharge device according to claim 1, wherein the drive voltage value Voff of the contraction pulse is set such that an absolute value of the drive voltage value Voff of the contraction pulse is increased to equalize droplet speeds across the plurality of groups as the droplet speed of each group is reduced when a common drive signal is used for drive.

3. The droplet discharge device according to claim 1, further comprising a storage unit that stores information concerning the drive voltage value Voff of the contraction pulse for each group, wherein the drive voltage value Voff of the contraction pulse is set by making reference to the information stored in the storage unit.

4. The droplet discharge device according to claim 1, wherein the plurality of nozzles are aligned in a plurality of arrays and divided to form the plurality of groups in accordance with each array.

5. The droplet discharge device according to claim 1, the contraction pulse of the drive signal has a pulse width of 2 AL.

6. The droplet discharge device according to claim 1, the expansion pulse of the drive signal has a pulse width of 1 AL.

7. A method for driving a droplet discharge head which comprises: (i) a plurality of nozzles that discharge droplets; (ii) a plurality of pressure chambers communicating with the nozzles; and (iii) a plurality of piezoelectric material substrates that change a capacity of each pressure chamber by application of a drive signal which is generated by a drive signal generation circuit, wherein the drive signal comprises an expansion pulse to expand a capacity of each pressure chamber and a contraction pulse to contract the capacity of each pressure chamber, the method comprising:

a discharging process of dividing the plurality of nozzles into a plurality of nozzle groups each comprising one or more nozzles and corresponding to the piezoelectric material substrates, applying to the droplet discharge head the drive signal which has a drive voltage value Von of the expansion pulse set to be common to the respective groups and a drive voltage value Voff of the contraction pulse independently set in accordance with a droplet speed level in each group, and discharging droplets, wherein the expansion pulse expands the capacity of each pressure chamber from a predetermined reference state and then restores the capacity to the reference state, and the contraction pulse subsequently contracts the capacity of each pressure chamber and then restores the capacity to the reference state, and wherein the drive voltage value Von of the expansion pulse and the drive voltage value Voff of the contraction pulse are set such that $|Von|/|Voff|$ is not less than 1 and not more than 2, where the drive voltage value Von of the expansion pulse is a voltage corresponding to a difference from a reference voltage value in the reference state, and the drive voltage value Voff of the contraction pulse is a voltage corresponding to a difference from the reference voltage.

8. The method for driving a droplet discharge head according to claim 7, wherein, in the discharging process, the drive voltage value Voff of the contraction pulse is set such that an absolute value of the drive voltage value Voff of the contraction pulse is increased to substantially equalize droplet speeds across the plurality of groups as the droplet speed of each group is reduced when a common drive signal is used for drive.

9. The method for driving a droplet discharge head according to claim 7, further comprising a storing process of storing information concerning the drive voltage value Voff of the contraction pulse for each group in a storage unit before the discharging process, wherein, in the discharging process, the drive voltage value Voff of the contraction pulse is set by making reference to the information stored in the storage unit.

10. The method for driving a droplet discharge head according to claim 9, further comprising, before the storing process, a determining process of applying, to each of the groups of the droplet discharge head, a plurality of the drive signals in a plurality of respective stages, wherein each drive signal has a same fixed drive voltage value Von for the expansion pulse and a drive voltage value Voff for the contraction pulse that is changed in each respective stage, measuring a droplet speed in accordance with each group, and determining the drive voltage value Voff of the contraction pulse for each group in accordance with a droplet speed level, wherein, in the storing process, information concerning the drive voltage value Voff of the contraction pulse determined for each group in the determining process is stored in the storage unit.

* * * * *